US006883456B1

(12) United States Patent
Hickok

(10) Patent No.: US 6,883,456 B1
(45) Date of Patent: Apr. 26, 2005

(54) COLLAPSIBLE ROOF ASSEMBLY AND METHOD FOR A BOAT OR THE LIKE

(75) Inventor: William L. Hickok, Everson, WA (US)

(73) Assignee: Aluminum Chambered Boats, Inc., Bellingham, WA (US)

( * ) Notice: Subject to any disclaimer, the term of this patent is extended or adjusted under 35 U.S.C. 154(b) by 0 days.

(21) Appl. No.: 10/775,659

(22) Filed: Feb. 9, 2004

Related U.S. Application Data

(60) Provisional application No. 60/445,506, filed on Feb. 7, 2003.

(51) Int. Cl.[7] ..... B63B 17/00

(52) U.S. Cl. ..... 114/361

(58) Field of Search ..... 114/361; 135/88.01–88.03

(56) References Cited

U.S. PATENT DOCUMENTS

| | | | | |
|---|---|---|---|---|
| 6,349,666 | B1 * | 2/2002 | Hastings | 114/361 |
| 6,666,163 | B2 * | 12/2003 | Pastor et al. | 114/361 |
| 2003/0217683 | A1 * | 11/2003 | Heckman | 114/361 |

* cited by examiner

*Primary Examiner*—Ed Swinehart
(74) *Attorney, Agent, or Firm*—Robert B. Hughes; Hughes Law Firm, PLLC

(57) ABSTRACT

A collapsible roof assembly for a boat or other base structure where there is a roof structure mounted by a collapsible frame. The frame has right and left portions, each having front, intermediate and rear strut sections connected between the roof structure and the boat. The front struts can be disconnected and permit the roof structure to be rotated with its rear portion being lowered to a position where it is braced relative to the intermediate struts. Then the roof structure is moved forwardly and downwardly to it's collapsed position.

3 Claims, 3 Drawing Sheets

COLLAPSIBLE ROOF ASSEMBLY AND METHOD FOR A BOAT OR THE LIKE

RELATED APPLICATIONS

This application claims priority benefit of U.S. Ser. No. 60/445,506, filed Feb. 7, 2003.

BACKGROUND OF THE INVENTION a) Field of the Invention

The present invention relates to a collapsible roof assembly which can be used for a boat or other situations.

b) Background of the Invention

Quite often a boat, such as a small or medium size power boat has a roof structure over at least a portion of the boat. To accommodate the person or persons in the boat, the roof structure must be at a sufficiently high level above the deck of the boat. There are some situations where the boat is to be stored or shipped in a confined structure relative to it's total height dimension. In these situations it is desirable that roof structure could be moved to a lower location so as to reduce the overall height dimension. Beyond this, it would be obviously desirable if the movement of the roof structure between the upper deployed position and its lower collapsed position could be done as conveniently as possible.

DETAILED DESCRIPTION OF THE PREFERRED EMBODIMENTS

Figure 1:
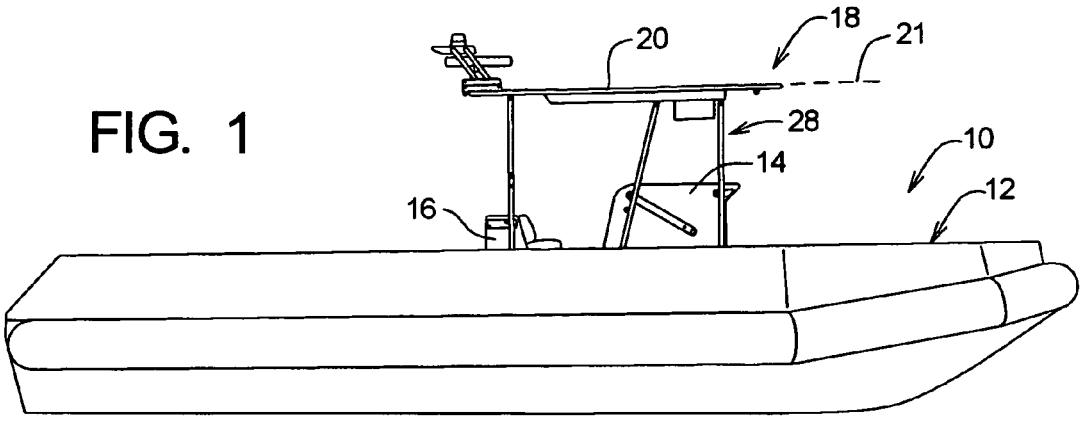
FIG. 1 is a side elevational view of a boat incorporating the present invention.

In FIG. 1, there is shown a boat 10 comprising hull 12 having a bridge structure 14 in which there is located the steering apparatus, various controls, communication equipment, and possibly other auxiliary items. Positioned rearwardly of the bridge structure 14 is a seat structure 16.

The collapsible roof assembly 18 of the present invention comprises a roof structure 20 which in FIG. 1 is shown in its upper deployed position at an upper location extending horizontally over the bridge structure 14 and the seat structure 16. The roof structure 20 has a longitudinal axis 21, a front end 22 and a rear end 24. At the rear end of the roof structure 20 there is mounted on top of the roof structure auxiliary equipment, such as a radar detection unit 26.

The roof structure is supported by a collapsible support frame 28 which comprises identical (or substantially identical) right and left frame sections. The collapsible frame 28 comprises two front struts 30, two intermediate struts 32, and two rear two-part struts 34. Each pair of struts has the struts positioned on opposite sides of the hull 12 so as to form front, intermediate, and rear strut sections. The two rear struts 34 each comprise an upper rear strut portion 36 and a lower rear strut portion 38. In the side elevational views of FIGS. 2–6, only the starboard side struts 30–34 can be seen. As will be described later herein, each upper rear strut portion 36 functions as a bracing member, in addition to providing a roof structure support functions as part of the rear strut section 34.

Since the two oppositely positioned struts 30, 32 and 34 and their associated components, connections and locations are substantially identical, in the following text when reference is made to a component at the side of the frame, it is intended to also refer to the corresponding component on the other side of the frame.

The two front struts 30 each have, at a lower end portion 40 thereof, a lower pivot connection 42 which is at a lower forward location of a related sidewall 44 of the bridge structure 14. The upper end portion 46 of the front struts 30 each have a removable upper connection 48 to a forward side portion of the roof structure 20.

Also, the forward strut 30 has at an intermediate location along its length, a connection 49 to the sidewall 44 of the bridge structure 16 at an upper forward location thereof.

The two intermediate struts 32 each have a lower pivot connection 50 at a lower rear portion of related sidewall 44 of the bridge structure 14. Also, each intermediate strut 32 has an upper pivot location 52 to the roof structure 20 at a location spaced rearwardly from the upper forward connection 46. Also, the two intermediate struts 32 each have a releasable connection at 53 to an upper rear location on the bridge structure sidewall 44.

Each rear two-part strut 34 has a lower pivot connection 54 at a sidewall 56 of the seat structure 16, and an upper pivot connection 58 to a rear part of the roof structure 20, this connection 58 being rearward of the upper connection 52 of the intermediate strut 32. The upper and lower rear strut portions 36 and 38 are connected at a middle location by two spaced bolt connections at 60, so that in their connected position at FIG. 2, the two rear strut portions 36 and 38 function as a single rigid strut.

Figure 2:
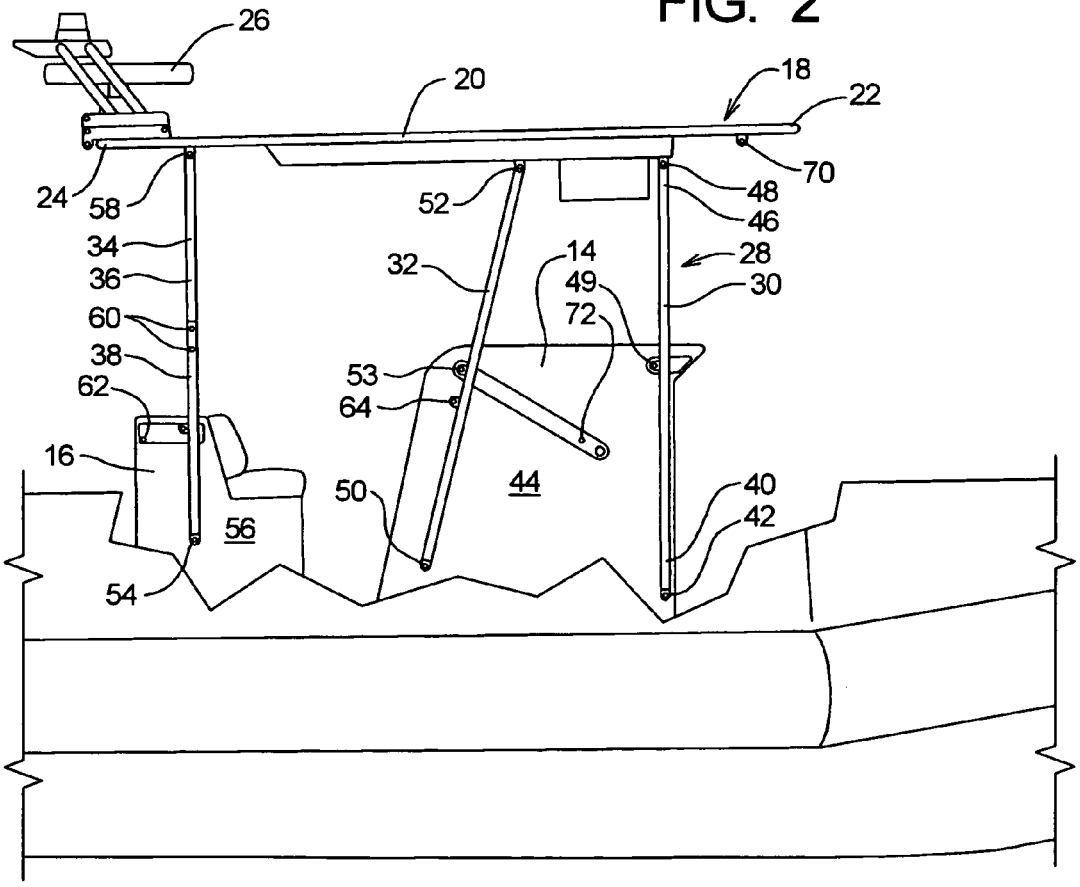
FIGS. 2–6 are side elevational views, drawn to an enlarged scale, and showing the collapsible cover system in sequential operating positions from an upper covering position of FIG. 2 to the collapsed position of FIG. 6.

It can be seen that in the upper deployed position of FIGS. 1 and 2 the support frame 28 functions as a rigid structure to properly support the roof structure 20 in an upper horizontal covering position. To move the roof structure 20 from the position in FIGS. 1 and 2 to the stowed position of FIG. 6, the following steps are followed.

Figure 3:
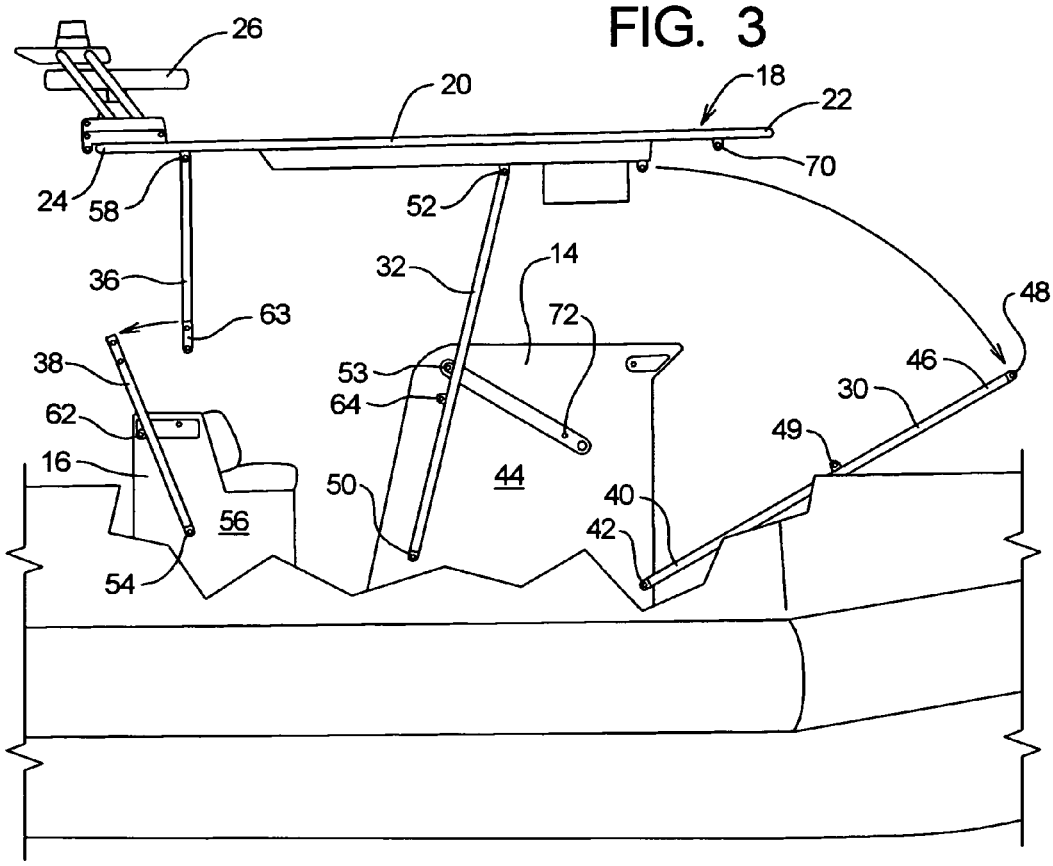

First, as shown in FIG. 3, each of the forward struts 30 is disconnected at its upper connecting location 48 and also at its intermediate connecting location 49, and the two front struts 30 are moved forwardly and downwardly to a rest position on the boat structure, as shown in FIG. 3. Then, the upper and lower rear strut portions 36 and 38 of the two rear struts 34 are disconnected from one another at the two bolt connecting location 60, and the lower strut portion 38 is simply moved rearwardly to a rest position where it can be supported, for example, by a protrusion shown at 62.

Figure 4:
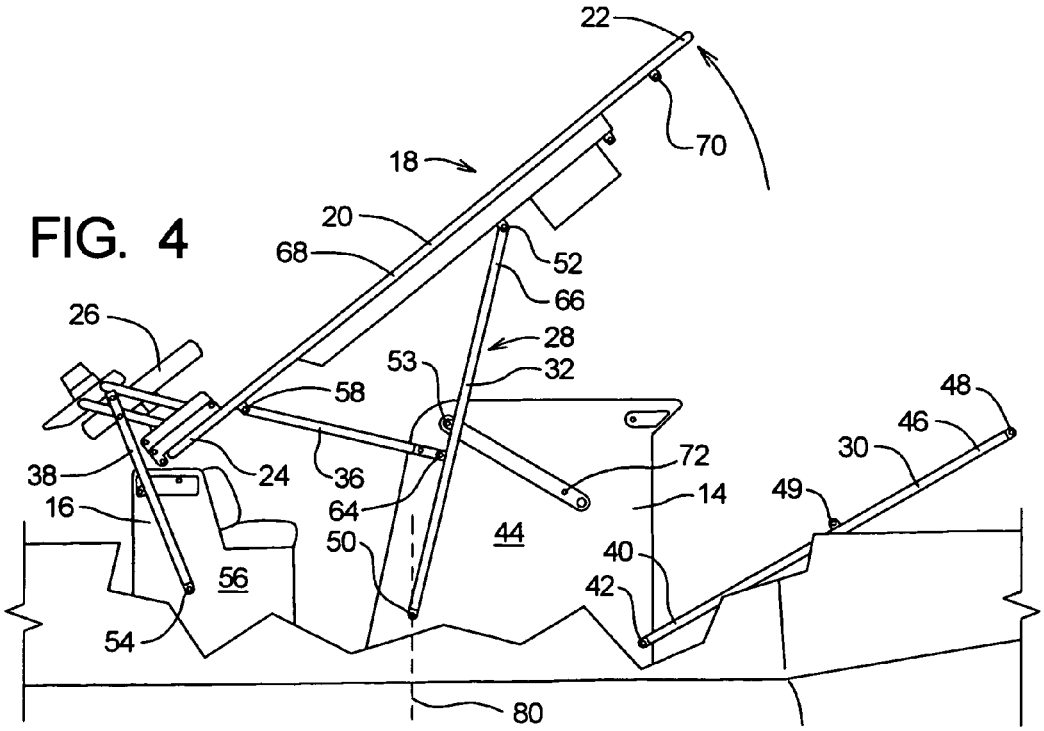

The next step is to move the rear portion 24 of the roof structure 20 downwardly to the position of FIG. 4, with the roof structure 20 pivoting about the pivot location 52 of the intermediate strut 32 which still remains in its fixed position. When the roof structure 20 reaches the position of FIG. 4, the lower connecting portion 63 of the upper bracing strut portion 36 is swung in a forward and upward direction to the position of FIG. 4, and a connection is made at 64 at an intermediate location of the intermediate strut 32. Thus, it can be seen that the upper rear strut portion 36, the upper part 66 of the strut 32, and a section 68 of the roof structure 20 that is between the pivot connection 52 and the connection 58 make a rigid, triangular structure with the upper strut portion 36 functioning as a brace. Thus, the entire roof structure 20, along with the upper rear strut portions 36, and the two struts 32 form a rigid structure.

Figure 5:
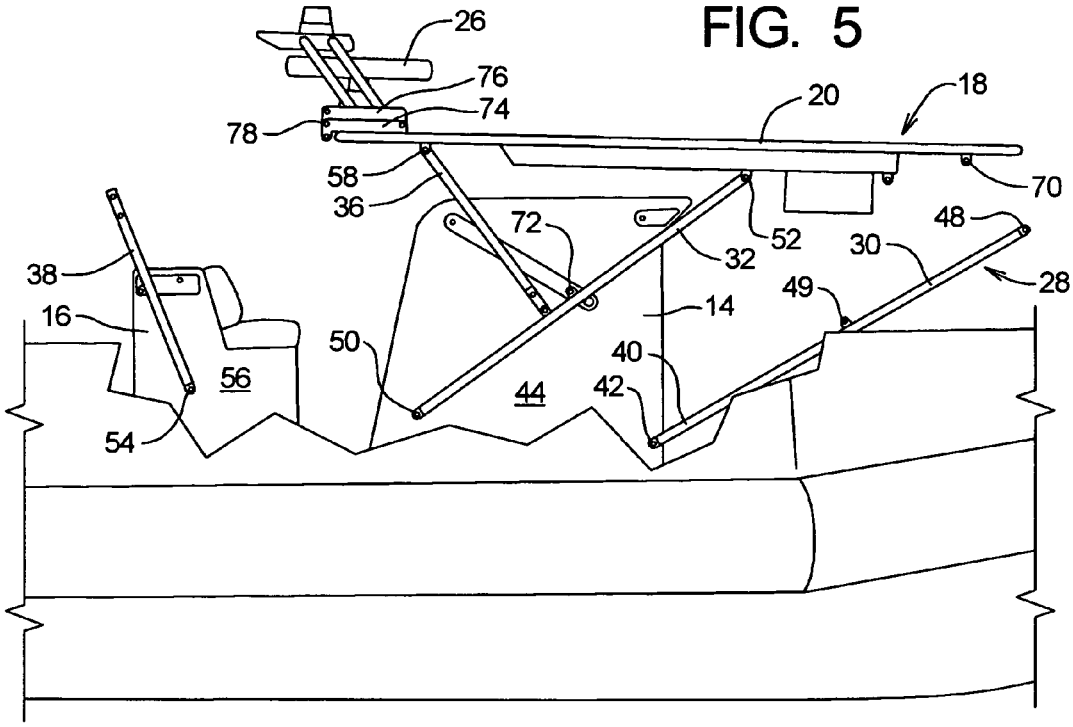

With this being accomplished, the connection at the releasable connecting location 53 is released, and the roof structure 20, along with the struts 32 and strut portions 36 are moved in a forward and downward direction to the position of FIG. 5. It can be seen that in the position of FIG. 5, the roof structure 20 is in its horizontal position at a lower elevation. The front connection 48 of each front strut 30 may then be connected at a connecting location 70 at the front of the roof structure 70. Also, a middle portion of each intermediate strut 32 may be connected at 72 to the side of the bridge structure 14.

With the roof structure 20 now being in its lower stowed position, it may be necessary or desirable to bring the auxiliary equipment 26 (shown as a radar unit) to a lower location. This radar unit 26 is mounted by means of a base plate 74 to the rear end of the roof 20, and there is a moveable support plate 76 which is hinge-mounted to the base plate 74 at 78. The auxiliary equipment, which is shown as a radar unit 26, is mounted so that in the configuration of FIG. 5, the unit 26 is positioned at an upper location. When moved down to the configuration of FIG. 6, the unit 74 is positioned below the level of the roof 20.

To review some of the functional features of this embodiment of the present invention, let us first look at the roof assembly 18 in its upper deployed position as shown in FIGS. 1 and 2. The boat 10 can be considered as a base structure supporting the roof assembly 18, with the boat 10 having a forward base connecting location at the lower pivot location 42 of each of the front struts 30 and a second base connecting location which is at the location of the lower pivot connection 50 of the strut 32. Further, there is a third base connecting location which is at the lower connection 54 of the rear two part strut 34.

Then the roof structure 20 has a front roof connecting location at the location of the upper end connection 48 of the front strut 30 when in it's connected position of FIG. 2. There is a second roof connecting location at the upper pivot connection 52 of the intermediate strut 32, and also a third roof connecting location at the upper pivot location 58 of the rear two part strut 34.

In the upper deployed position of FIGS. 1 and 2, the three pair of struts 30, 32, and 34 support the weight of the roof structure 20. The two rear struts 34 in the position of upper deployed position of FIGS. 1 and 2 have the two strut portions 36 and 38 locked to one another by the bolt connections at 60 so that these collectively function as a rigid strut providing support for the roof structure 20. The connection at 53 at an intermediate portion of the rod 32 prevents forward and rear movement of the roof structure 20, as does the connection at 49 at an intermediate portion of the forward struts 30.

Figure 6:
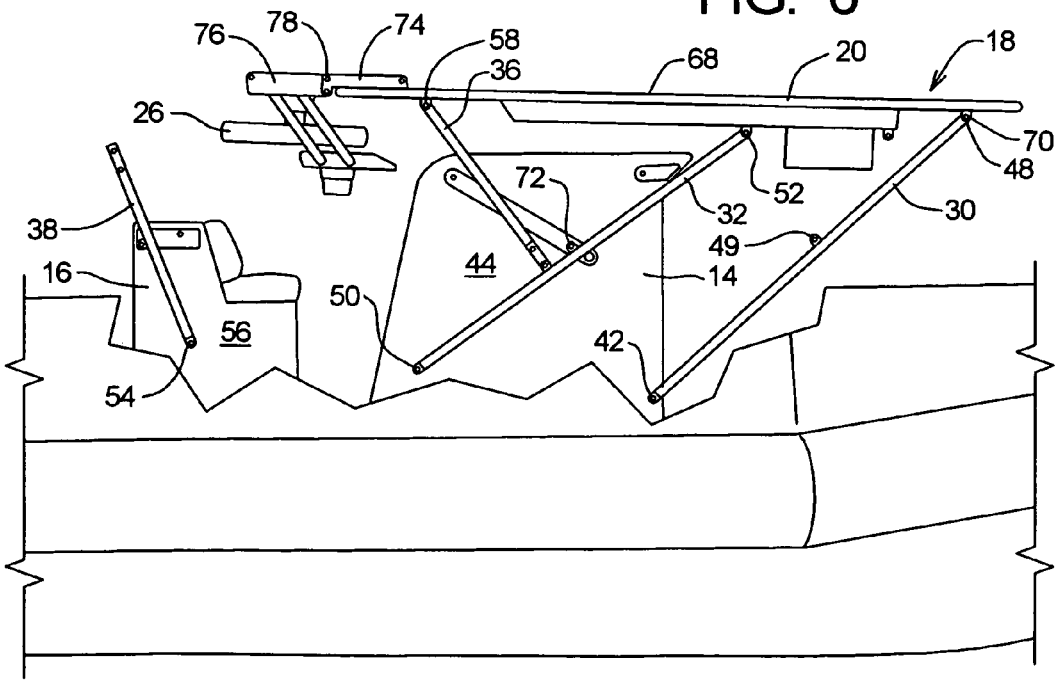

Then, as can be seen in FIG. 3, the first step in moving the roof assembly 18 from the upper deployed position of FIG. 2 toward it's fully collapsed position in FIG. 6 is to disconnect the upper connection 48 of each of the front struts 30 from the connecting position as shown in FIG. 2 and move the two front struts downwardly, as shown in FIG. 3. When this done, the intermediate struts 32 and the rear struts 34 are positioned so that these alone can provide a rigid support frame portion for the roof structure 20, since the forward struts 32 each are connected at the lower pivot location 50 and also at the intermediate location 53.

Then the next step in moving from the upper deployed position of FIG. 2 is to make a disconnection at the two bolt connecting locations 60 to release the upper rear strut portion 36 from the lower strut portion 38. When this is done, the roof structure 20 is able to pivot about the upper pivot location 52, and the entire weight of the roof structure 20 is supported by the two intermediate struts 32.

The location of the connections 52 along the longitudinal axis 21 is such so that the weight of the roof structure 20 is distributed both forwardly and rearwardly of the connecting location 52. In this arrangement of the embodiment, the distribution of the weight is such that gravity will cause the rear portion of the roof structure 20 to have a moderate force moment acting to rotate the rear portion of the roof structure 20 downwardly toward the location of FIG. 4. If one person is performing the task of moving the roof structure 20 from it's upper deployed position to it's collapsed position, the weight distribution would be such that the accomplishing of the movement of the roof structure 20 from the position of FIG. 3 to that of FIG. 4 can be accomplished without requiring any substantial physical force to be exerted.

Then when the rear part of the roof structure 20 has rotated down to the position of FIG. 4, the upper pivot location 58 is spaced from the connecting location at a distance 64 so that the two upper strut portions 36 are able to have the connections made at 64. Thus, it will be noted that the upper strut portion 36 now functions as a brace between the strut 32 and the roof portion 68 between the connecting locations 52 and 58.

In the position of FIG. 4, the two intermediate struts 32 still are connected at the connecting locations 53 to the base structure, which in this instance is the bridge structure 14. It will be noted that in the position of FIG. 2 and also the intermediate positions of FIGS. 3 and 4 the struts 32 extend upwardly and moderately forwardly so that these lean in a forward direction. Thus, the upper connecting locations 52 are a short distance forward of the lower pivot locations at 50. Therefore, in performing the operation shown in FIG. 3 where the rear portion of the roof structure 20 is rotated downwardly, the center of rotation is at the upper connecting location 52. In that instance, the force moment resulting from the force of gravity on that portion of the roof structure 20 that is rearwardly of the connecting location 52 is moderately greater then the gravitational force moment exerted on the portion of the roof structure forwardly of the connecting location 52. Thus, in lowering the rear portion of the roof from the position of FIG. 3 to that of FIG. 4, the person or persons doing so would be primarily resisting the downward force of the rear portion of the roof structure 20.

Now, in the position of FIG. 4, with the roof structure 20, the brace strut portions 36 and the two intermediate struts 32 forming a rigid structure, the rotation is about the more rearward connecting location 50. The components are arranged so that the mass of the roof structure that would provide a force moment of the forward part of the roof structure 20 in a downward direction would be to the right of the vertical line 80 that passes through the connecting location 50. Thus, the center of gravity of the roof structure 20 plus the equipment mounted there to, such as shown at 26, may be located so that there is a reasonable distribution of the total weight of the roof structure plus any equipment, such as 26 on opposite sides of the pivot location 50. Thus, there is a relatively small net rotational moment exerted on the roof structure. This enables the disconnect at the connecting location 53 to be made more easily.

Therefore, as the roof structure 20 is rotated forwardly and downwardly from the position of FIG. 4 of the position of FIG. 5, the forward end of the roof structure 20 will be lowered more toward the horizontal position of FIG. 5, and as the center of gravity moves further forward from the connection location 50, the net upward force that would be needed to resist the force moment exerted by gravity on the roof structure 20 will increase. At the same time, however, the more forward end of the roof structure 20 is moving downwardly to a position where an upward force could be exerted by a person or persons to moderate the downward motion of the roof structure 20 to a sufficiently slow rate of descent.

Of course, in moving the roof structure 20 from the stowed position of FIG. 6, the same gravitational forces shall be exerted as described above but in reversed order. Thus, when the various connections and disconnections are being made, the weight distribution is such that these tasks are facilitated. Accordingly, when the roof structure 20 is moved from the position of FIG. 5 to that of FIG. 4, the connection at 53 can more easily be made. Further, when the roof 20 is to be rotated from the location at FIG. 4 to the location of FIG. 3, the weight distribution is such so that a person can more easily make the disconnection at 64, and also move the two rear strut portion 36 and 38 together and make the bolt connections at 63. Then the connection 48 can be made at the location of FIG. 2.

It is obvious that various modifications could be made to the present invention without departing from the basic teachings thereof.

I claim:

1. A collapsible roof assembly adapted to be mounted to a base structure which has two oppositely positioned side portions, each of which has a first forward base connecting location, and a second base connecting location located rearwardly of said first base locations, said assembly comprising:

a) a roof structure having a longitudinal axis, a front end, a rear end and oppositely positioned side portions, with each side portion comprising a first front roof connecting location, a second roof connecting location located rearwardly of the first front roof connecting locations, and a third rear roof connecting location spaced rearwardly from said second roof connecting location;

b) a collapsible support frame comprising oppositely positioned frame side portions, each of which comprises:

i) a first front strut section having a lower front strut connection at said first forward base location, and an upper front strut connection at said first front roof connecting location;

ii) a second strut section having a lower second strut pivot connection at said second base location, and upper second strut pivot connection at said second roof connecting location and a second strut brace connecting location spaced from said upper second strut pivot location;

iii) a brace section having first and second brace connecting end portions which in a bracing position are connected, respectively, to said third roof connecting location and to said second strut section brace connecting location;

c) said assembly having a deployed upper position where each of the first and second strut sections are connected respectively to the base structure and the roof structure and are more vertically aligned to support the roof structure in the upper deployed position;

d) said assembly being arranged so that each of the first front strut sections is able to be disconnected from a connecting position between said roof structure and said base structure to permit said roof structure to be rotated to a bracing position where the rear end of the roof structure is lowered and each brace section is connected between the roof structure and the related second strut section to restrict relative rotational movement of the two second strut sections relative to the roof structure;

e) said assembly being arranged so that with the roof structure, each of the second strut sections and the brace section can, in the bracing position be rotated about said lower second strut pivot connections to a collapsed position.

2. The assembly as recited in claim 1 wherein each frame side portion comprises a third strut section which is a two part strut section comprising an upper third strut portion which in turn comprises the brace section, and a lower third strut portion which has a lower end connecting to the base structure at a third base connecting location positioned rearwardly of said second base connecting location, said upper third strut portion having a rigid, but releasable connection to said lower third strut portion to enable said upper third strut portion to function its bracing function.

3. A method of mounting a collapsible roof assembly to a base structure which has two oppositely positioned side portions, and moving the assembly from an upper deployed position to a collapsed position, said method comprising:

a) providing a roof structure having a longitudinal axis, a front end, a rear end and oppositely positioned side portions, with each side portion comprising first front roof connecting location, a second roof connecting location located rearwardly of the first front roof connecting locations, and a third rear roof connecting location spaced rearwardly from said second roof connecting location;

b) providing a collapsible support frame comprising a first front strut section, a second strut section and a brace section;

c) connecting a lower front strut connection of said front strut section location, and connecting an upper front strut connection at a first roof connecting location;

d) connecting a lower second strut pivot connection of said second strut section to said second base location, and connecting upper second strut pivot connection of said second strut connection to said second roof connecting location and providing a second strut brace connecting location spaced from said upper second strut pivot location;

e) providing said brace section with first and second brace connecting end portion;

f) positioning said roof structure and said frame in a deployed upper position where each of the first and second strut sections are connected respectively to the base structure and the roof structure and are more vertically aligned to support the roof structure in the upper deployed position;

g) disconnecting each of the first front strut sections from a connecting position between said roof structure and said base structure to permit said roof structure to be rotated to a bracing position where the rear end of the roof structure is lowered, and connecting the brace sections between the roof structure and the second strut section to restrict relative rotational movement of the second strut section relative to the roof structure;

h) rotating the roof structure, each of the second strut sections and each of the brace sections together about said lower second strut pivot connection to a collapsed position.

* * * * *